US010920451B2

(12) United States Patent
Park et al.

(10) Patent No.: US 10,920,451 B2
(45) Date of Patent: Feb. 16, 2021

(54) INTERFACE MODULE DEVICE OF DIGITAL DOOR LOCK

(71) Applicant: AMADAS Co., LTD., Seoul (KR)

(72) Inventors: Eun Min Park, Seongnam-si (KR); Sang Woo Jung, Busan (KR)

(73) Assignee: AMADAS CO., LTD., Seoul (KR)

( * ) Notice: Subject to any disclaimer, the term of this patent is extended or adjusted under 35 U.S.C. 154(b) by 543 days.

(21) Appl. No.: 15/805,214

(22) Filed: Nov. 7, 2017

(65) Prior Publication Data

US 2018/0128013 A1 May 10, 2018

(30) Foreign Application Priority Data

Nov. 10, 2016 (KR) ..... 10-2016-0149536

(51) Int. Cl.

| | |
|---|---|
| ***E05B 81/00*** | (2014.01) |
| ***E05B 9/08*** | (2006.01) |
| ***E05B 3/06*** | (2006.01) |
| ***E05B 63/00*** | (2006.01) |
| *E05B 3/02* | (2006.01) |
| *E05B 15/02* | (2006.01) |

(52) U.S. Cl.

CPC ..... *E05B 9/082* (2013.01); *E05B 3/06* (2013.01); *E05B 63/0056* (2013.01); *E05B 15/02* (2013.01); *Y10T 292/85* (2015.04); *Y10T 292/858* (2015.04)

(58) Field of Classification Search

CPC . E05B 9/082; E05B 3/06; E05B 15/02; E05B 63/0056; Y10T 292/82; Y10T 292/85; Y10T 292/858; Y10T 292/88; Y10T 292/91

See application file for complete search history.

(56) References Cited

U.S. PATENT DOCUMENTS 2,491,783 A * 12/1949 Thomas ..... E05C 1/163 292/169.19
3,427,061 A * 2/1969 Gresham ..... E05B 3/003 292/353

(Continued)

FOREIGN PATENT DOCUMENTS

DE 102009059327 * 7/2011
EP 1722113 * 11/2006

(Continued)

OTHER PUBLICATIONS

"How to Change a Commercial Door Lock in 9 Easy Steps", The-Asterisk, Jan. 31, 2016. Retrieved from http://the-asterisk.blogspot.kr/2016/01/how-to-change-commercial-door-lock-in-9.html.

*Primary Examiner* — Carlos Lugo
(74) *Attorney, Agent, or Firm* — Rabin & Berdo, P.C.

(57) ABSTRACT

A digital door lock, and more particularly, an interface module device of a digital door lock is provided, which is capable of adjusting and aligning a position of a fastening bolt of the digital door lock so as to match fastening positions of a variety of locking devices while using a previously-installed locking device as it is. Accordingly, an interface module device for a door lock is provided, which includes a bracket, an interface bracket fastened with the bracket, and an interval alignment disposed between the bracket and the interface bracket to adjust an interval between fastening nuts inserted into fastening holes of the locking device.

3 Claims, 12 Drawing Sheets

(56) References Cited

U.S. PATENT DOCUMENTS

| | | | | | |
|---|---|---|---|---|---|
| 4,489,577 | A * | 12/1984 | Crepinsek | E05B 15/02 | 403/348 |
| 5,118,152 | A * | 6/1992 | Lin | E05B 3/06 | 292/356 |
| 5,409,278 | A * | 4/1995 | Harcourt | E05B 3/06 | 292/348 |
| 5,732,578 | A * | 3/1998 | Kang | E05B 3/065 | 292/336.3 |
| 6,745,602 | B2 * | 6/2004 | Nakasone | E05B 3/003 | 16/441 |
| 7,082,794 | B2 * | 8/2006 | Shen | E05B 17/0062 | 292/169.22 |
| 7,588,272 | B2 * | 9/2009 | Gephart | E05B 3/00 | 292/336.3 |
| 8,960,740 | B2 * | 2/2015 | Huang | E05B 15/02 | 292/347 |
| 2008/0116699 | A1 * | 5/2008 | Karcher | E05B 3/06 | 292/336.3 |

FOREIGN PATENT DOCUMENTS

| | | | | | |
|---|---|---|---|---|---|
| GB | 463214 | A * | 3/1937 | E05B 15/02 | |
| GB | 832634 | A * | 4/1960 | E05B 3/06 | |
| JP | H06-049774 | Y2 | 12/1994 | | |
| KR | 10-2014-0017905 | A | 2/2014 | | |
| WO | WO-9725500 | A1 * | 7/1997 | E05B 55/005 | |

* cited by examiner

INTERFACE MODULE DEVICE OF DIGITAL DOOR LOCK

BACKGROUND

Technical Field

The present disclosure relates to a digital door lock, and more particularly, to an interface module device of a digital door lock capable of adjusting and aligning a position of a fastening bolt of the digital door lock so as to match fastening positions of a variety of locking devices while using a previously-installed locking device as it is.

Background Art

Digital door locks are generally configured such that each model has its own designated locking device, thus giving the manufacturers of door locks around the world the burden of development to meet varying door lock standards, and also giving inconvenience and cost burden to the consumers who have to replace the digital door lock, because it is necessary to replace not only the digital door lock, but also the corresponding locking device.

Since the previously-installed locking device already satisfies the standard of the door for which it is installed, it will be possible to automatically satisfy the door standard and also enhance convenience of installation if a user installs the digital door lock using the previously-installed locking device as it is, and the manufacturers can significantly save cost of development, production and sales management, as they can meet varying standards of doors with one single digital door lock.

Prior Art Documents

Patent Documents (Patent Document 1) Korean Patent Publication No. 10-2014-0017905

SUMMARY

The present disclosure has been made to solve the problems mentioned above, and accordingly, it is an object of the present disclosure to provide a digital door lock having a variable interface module function capable of fastening adaptively to a variety of previously-installed locking devices.

It is another object of the present disclosure to provide a digital door lock capable of adjusting an angle of positions of fastening bolts inserted into a locking device.

It is yet another object of the present disclosure to provide a digital door lock capable of adjusting an interval between fastening bolts inserted into a locking device.

It is yet another object of the present disclosure to provide a digital door lock capable of adjusting an interval between the fastening bolts at regular intervals with respect to a center of rotation of a digital door lock lever so that the center of rotation of the locking device and the center of rotation of the digital door lock lever coincide with each other.

In order to achieve the above object, the present disclosure provides an interface module device for a door lock, which may include a bracket, an interface bracket fastened with the bracket, and an interval alignment disposed between the bracket and the interface bracket to adjust an interval between fastening nuts inserted into fastening holes of the locking device.

Further, in order to achieve the above object, the present disclosure provides an interface module device of a door lock, which may include an inner device bracket, an inner device interface bracket fastened with the inner device bracket, and an interval alignment disposed between the inner device bracket and the inner device interface bracket to adjust an interval between fastening bolts inserted into fastening holes of the locking device.

As described above, the present disclosure is advantageous in that a digital door lock can be installed using a previously-installed installed locking device as it is.

That is, the angle of the positions of the fastening bolts (fastening nuts) inserted into the locking device and the interval therebetween can be adjusted through the door lock interface module device according to an exemplary embodiment.

In addition, when the interval between the fastening bolts (fastening nuts) is adjusted, the fastening bolts (fastening nuts) are aligned at regular intervals with respect to the center of rotation of the lever, so that the center of rotation of the locking device and the center of rotation of the digital door lock lever always coincide and it is not necessary for a user to align the center of rotation.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Figure 1:
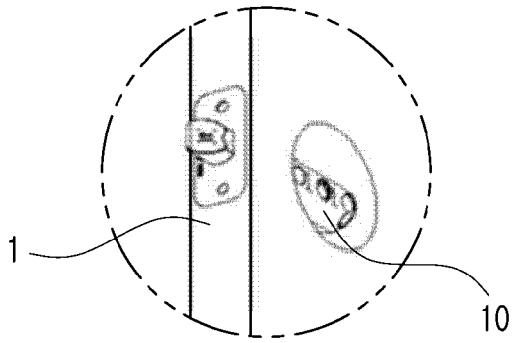
FIG. 1 is a view illustrating overall configuration of a digital door lock according to an exemplary embodiment.
Figure 1:
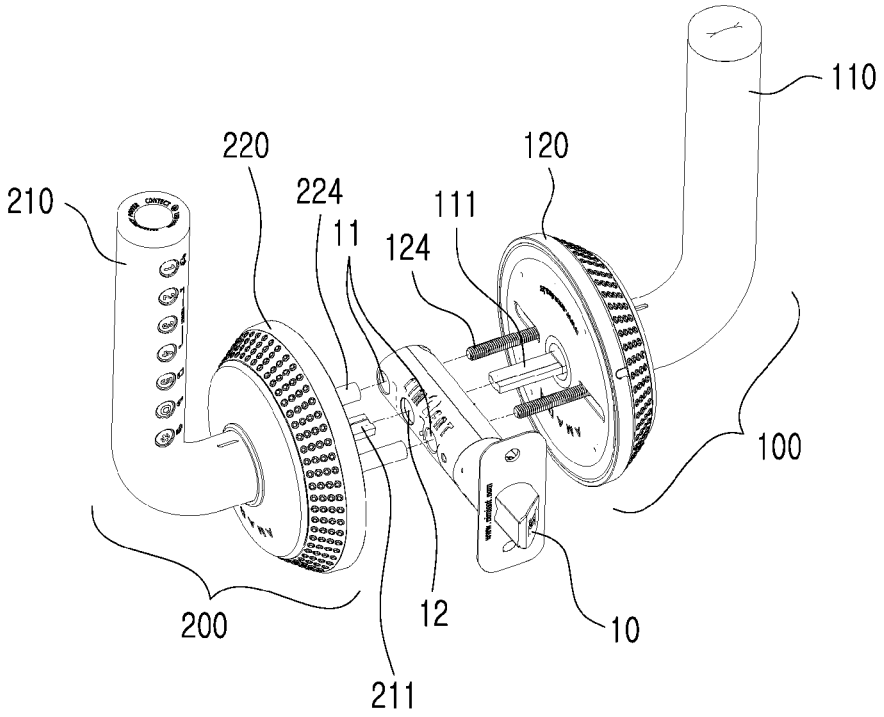

Hereinafter, embodiments of the present disclosure will be described in detail with reference to the accompanying drawings. The configuration of the present disclosure and operation and effect thereof will be clearly understood from the following detailed description.

Before describing the disclosure in detail, it is to be noted that the same elements are denoted by the same reference numerals even if they are illustrated in different drawings, and the detailed description of the known constitution will be omitted when it is considered to obscure the gist of the present disclosure.

According to an exemplary embodiment, the inner device door 100 and the outer device door 200 of the digital door lock are configured with the interface modules 120, 220 of the digital door lock respectively fastened with the digital door lock levers 110, 210, as illustrated in FIG. 1.

The fastening bolts 124 of the inner device 100 and the fastening nuts 224 of the outer device 200 are fastened through fastening holes 11 of the previously-installed locking device 10 in the door 1, and a rotation key 111 of the inner device and a rotation key 211 of the outer device are inserted into a rotation cam hole 12 of the locking device 10 and engaged with a driving part of the locking device 10. At this time, the centers of the rotation keys 111, 211 coincide with the center of the rotation cam hole 12 of the locking device. The locking device 10 includes both a tubular type locking device 11 and a box type locking device 20.

Figure 2:
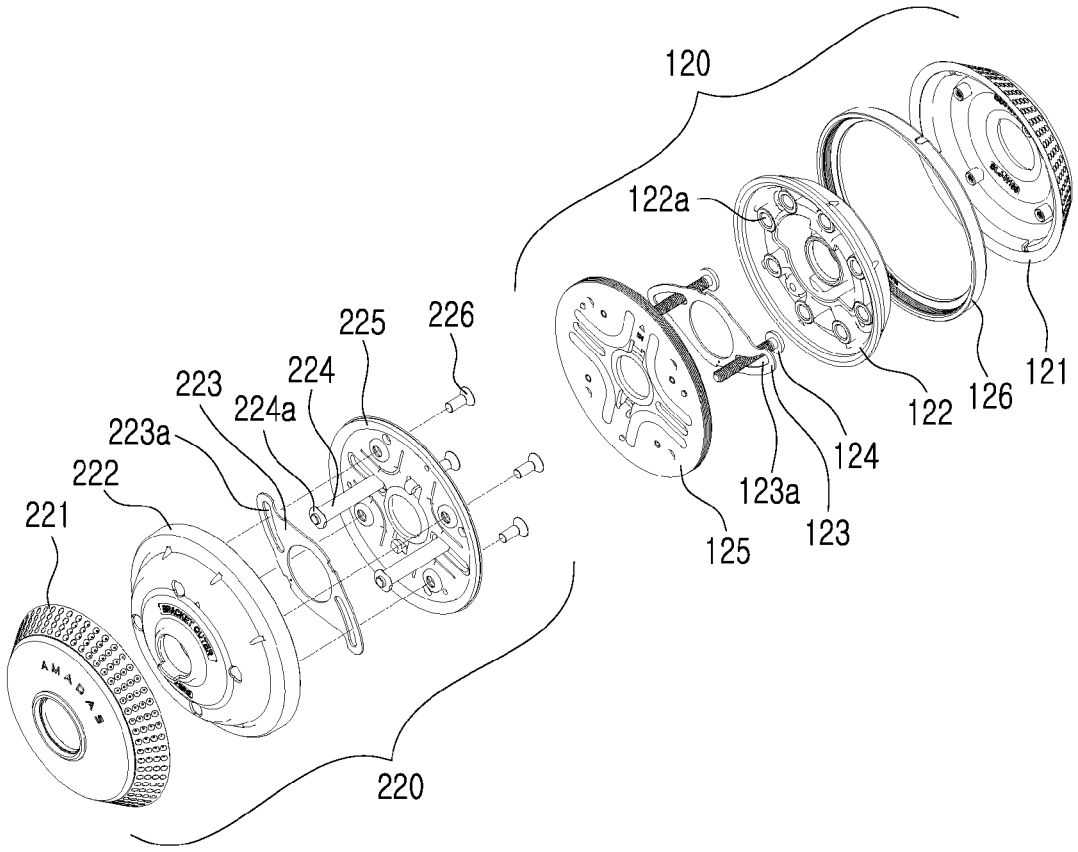
FIG. 2 is an exploded perspective view of outer device and inner device interface modules according to an exemplary embodiment.

The interface modules 120, 220 according to an exemplary embodiment are configured as illustrated in FIG. 2.

The inner device interface module 120 includes a bracket cover 121, an inner device bracket 122, an interval alignment 123, a fastening bolt 124, an inner device interface bracket 125, and a bracket fixture 126, and the outer device interface module 220 includes a bracket cover 221, an outer device bracket 222, an interval alignment 223, a fastening nut 224, an outer device interface bracket 225, and a bracket fixing bolt 226.

FIG. 3 illustrates the interface module 220 of the outer device 200 in the fastened state.

As illustrated in FIG. 2, the fastening nuts 224 are inserted into nut guides 225*d* of the interface bracket 225, and the interval between the fastening nuts 224 is adjusted as the fastening nuts 224 are moved along the nut guides 225*d*.

The interval alignment 223 is configured such that it is inserted between the first and second engaging protrusions 225*a*, 225*b* at the center of the interface bracket 225 and rotated therein, with a protrusion 224*a* of the head of the fastening nut 224 being inserted in the alignment guide 223*a*. Accordingly, the interval alignment 223 is rotated as the fastening nut 224 is moved.

Figure 3A:
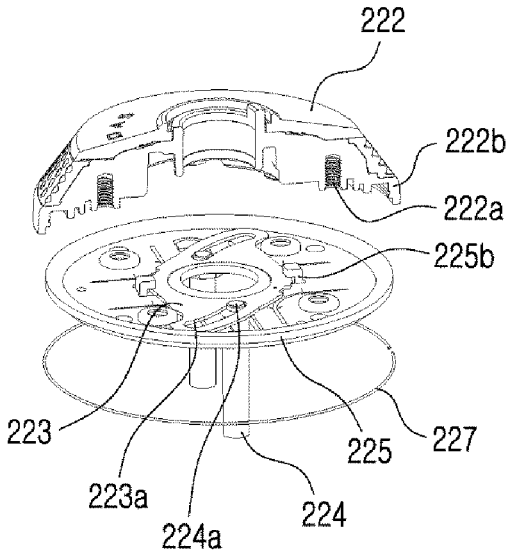
FIGS. 3A, 3B, 3C and 3D are, respectively, a view illustrating the components of an outer device interface module according to an exemplary embodiment.
Figure 3B:
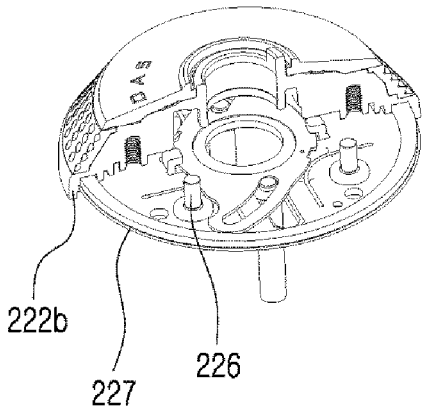

As illustrated in FIG. 3B, after the interface bracket 225 fastened with the interval alignment 223 is fitted in the bracket 222 and a retaining ring 227 is fastened with a bracket retaining groove 222*b*, the interface bracket 225 can be rotated 360 degrees while remaining fastened with the bracket 222.

Figure 3C:
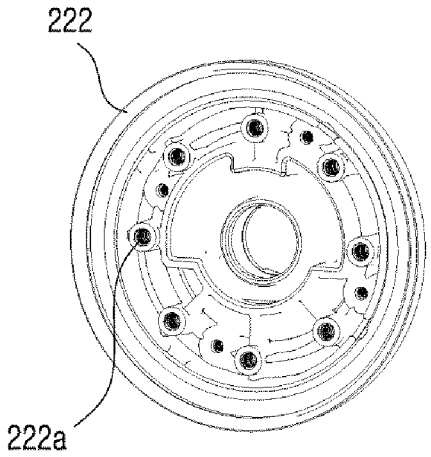
Figure 3D:
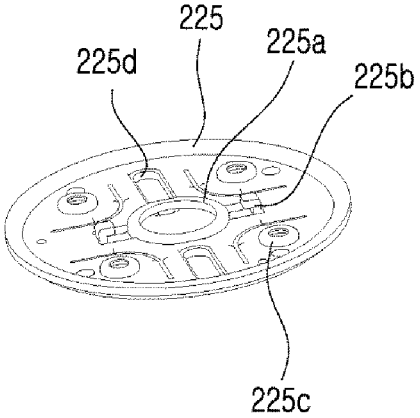

The fastening holes 225*c* of the interface bracket 225 are arranged at intervals of 90 degrees as illustrated in FIG. 3D, and the fastening holes 222*a* of the bracket 222 are arranged at intervals of 45 degrees as illustrated in FIG. 3C.

Therefore, rotating the interface bracket 225 at intervals of 45 degrees may always allow the fastening holes of the interface bracket 225 and the fastening holes of the bracket 222 to coincide with each other.

Figure 4:
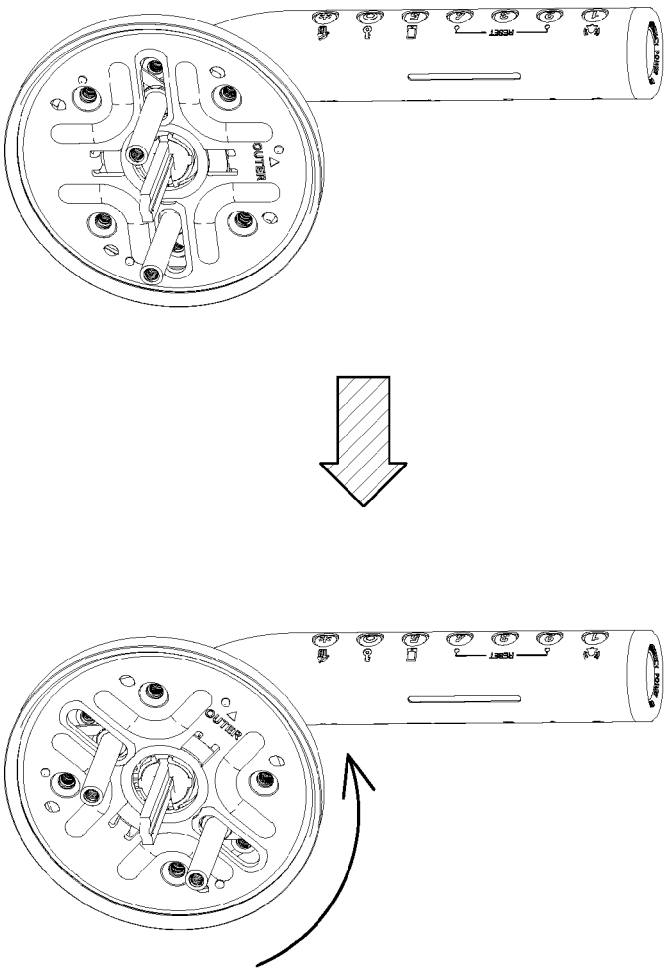
FIG. 4 is a view illustrating an outer device of a digital door lock according to an exemplary embodiment.

After the interface bracket 225 is rotated at intervals of 45 degrees to be aligned with the fastening holes 11, 21 of the locking devices 10, 20 as illustrated in FIG. 4, the bracket fixing bolt 226 is fastened with the bracket 222 through the interface bracket 225 as illustrated in FIG. 2, and the interface bracket 225 is fixed to the bracket 222.

Figure 5A:
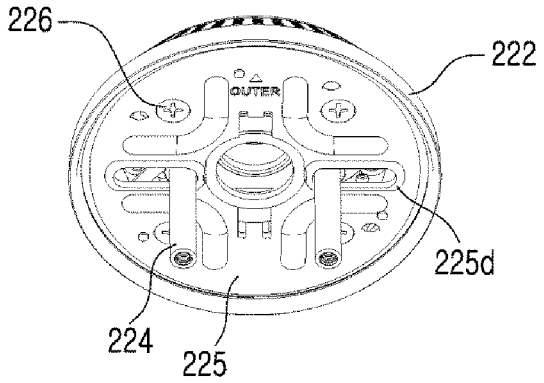
FIGS. 5A, 5B and 5C are, respectively, a view illustrating an outer device air interface module in which the interval between the fastening nuts is adjusted in according to an exemplary embodiment.

FIG. 5A illustrates the interface bracket 225 and the bracket 222 fastened after the interface bracket 225 is rotated to be aligned with the fastening direction of the locking devices 10, 20.

Figure 5B:
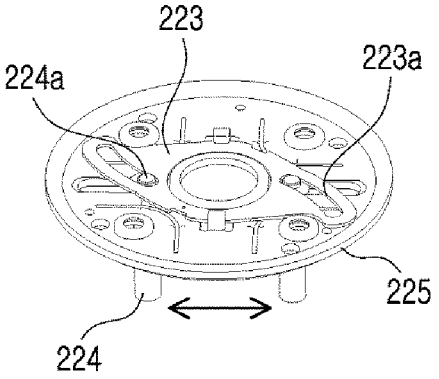
Figure 5C:
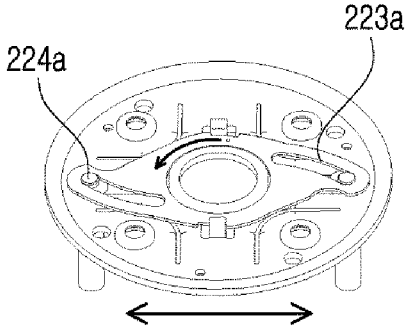

As illustrated in FIGS. 5B and 5C, the interval between the fastening nuts 224 is adjusted to align the fastening holes 11, 21 of the locking devices 10, 20 with the fastening nuts 224. In one example, when one of the fastening nuts 224 is moved, the other fastening nut 224 is also moved in the same manner to the opposite direction by the alignment guide 223*a*, and the fastening nuts 224 are always maintained symmetrical about the center of rotation by the alignment guide 223*a*.

Accordingly, the user may simply align the interval between the fastening nuts 224 to coincide with the fastening holes of the locking devices 10, 20 by using the alignment guide 223*a*, and it is not necessary to separately align the center of rotation of the locking devices 10, 20 with the center of rotation of the lever 210.

Figure 6A:
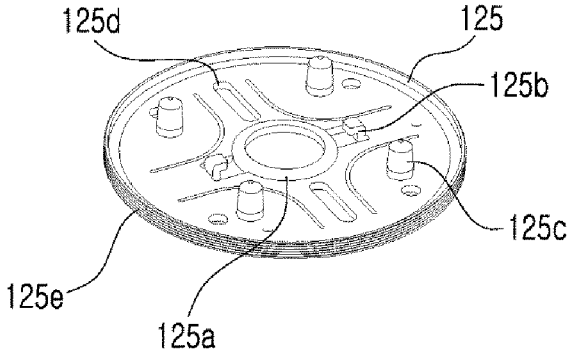
FIGS. 6A, 6B and 6C are, respectively, a view illustrating the components of an inner device interface module according to an exemplary embodiment.

The interface bracket 125 is a component of the inner device interface module 120 of the inner device 100 and includes studs 125*c* at intervals of 90 degrees as illustrated in FIG. 6A, and a fixing thread 125*e* is formed around the interface bracket 125.

Figure 6B:
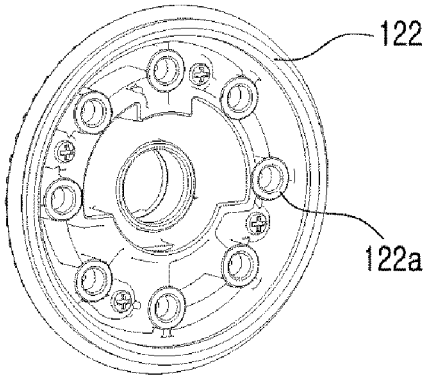

The inner device bracket 122 includes stud grooves 122*a* at intervals of 45 degrees to receive the studs 125*c* to be fitted therein, as illustrated in FIG. 6B. Accordingly, likewise the outer device 200, when the interface bracket 125 is rotated at intervals of 45 degrees and fastened, the studs 125*c* always coincide with the stud groove 122*a*.

The inner device bracket fixture 126 fitted into the bracket cover 121 and the engaging protrusion 122*b* of the bracket 122 is freely rotatable therein so that upon fastening of the inner device 100, the positions of the interface bracket 125 and the bracket 122 are adjusted by the studs 125*c*, and then the bracket fixture 126 is rotated to fix the interface bracket 125 and the bracket 122 by the respective threads 126*a*, 125*e*.

The interval alignment 123 of the inner device 100 is mounted and operated in the same manner as the outer device 200, and as illustrated in FIG. 2, a fastening bolt 124, which can be fastened with the fastening nut 224, is mounted on the inner device alignment guide 123*a*.

FIG. 7 illustrates a process in which the outer device 200 is fastened with the previously-installed box type locking device 20.

In FIG. 7, the illustration of the door 1 is omitted. In the locking device 20 illustrated in FIG. 7A according to one of various examples of the locking device, a fastening hole 21 is tilted at an angle of 45 degrees.

Figure 7A:
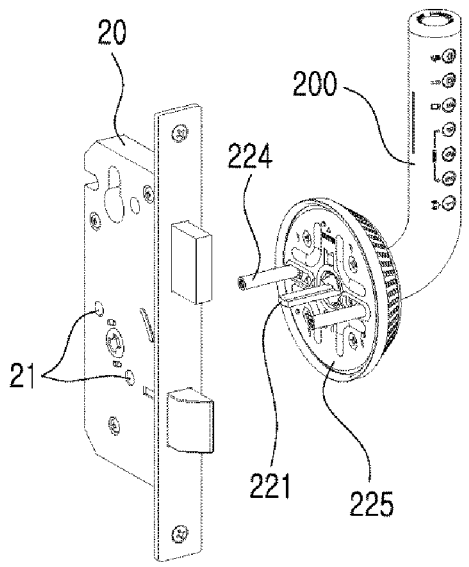
FIGS. 7A, 7B, 7C and 7D are, respectively, a view illustrating an outer device interface module being installed in a locking device according to an exemplary embodiment.
Figure 7B:
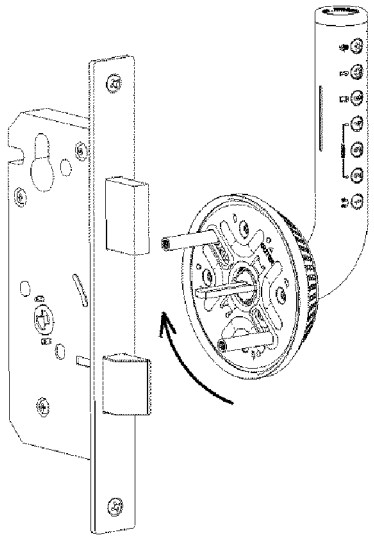
Figure 7C:
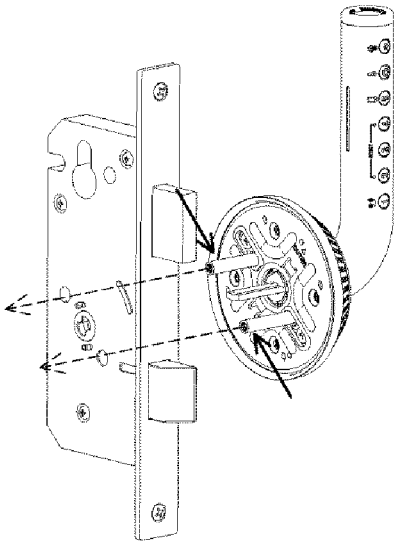

In this example, to align fastening holes, the interface bracket 225 is rotated so that the fastening parts are correspondingly inclined, as illustrated in FIG. 7B. When the user moves the fastening nuts as illustrated in FIG. 7C so that the interval between the fastening nuts 224 of the outer device 200 coincides with the interval between the locking device fastening holes 21 of the outer device 200, the two fastening nuts 224 are moved symmetrically about the center of rotation according to the mechanism as illustrated in FIG. 5.

Figure 7D:
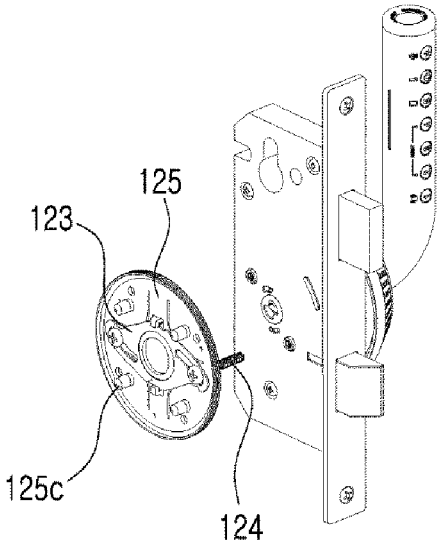

FIG. 7D illustrates the outer device fastened by aligning the fastening holes 21 of the locking device with the fastening nuts 224 of the outer device 200.

To fasten the inner device 100, the inner device interface bracket 125 is first fastened with the locking device 20 as illustrated in FIG. 7D.

FIG. 8 illustrates a process of fastening the inner device 100 to the outer device 200.

Figure 8A:
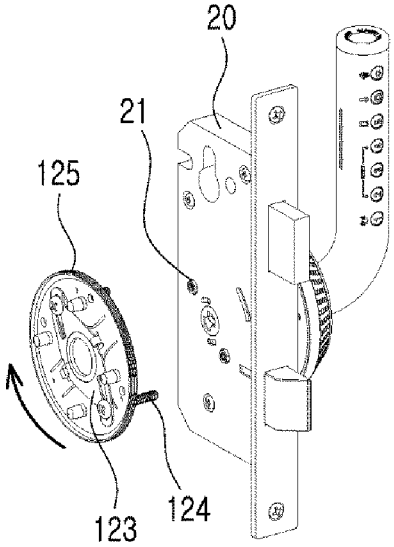
FIGS. 8A, 8B, 8C and 8D are, respectively, a view illustrating an inner device interface module being installed in a locking device according to an exemplary embodiment.
Figure 8B:
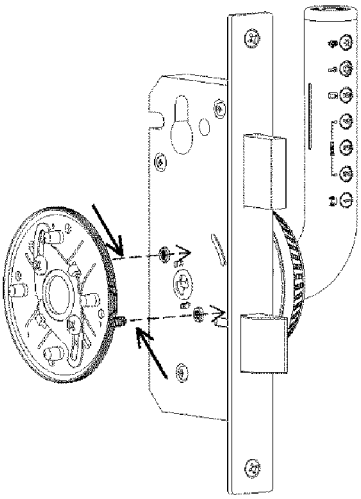

As described above, the inner device interface bracket 125 is intuitively rotated until the slopes of the locking device fastening hole 21 and the fastening nuts 224 are aligned with that of the fastening bolt 124, and then the interval between the fastening bolts 124 is adjusted according to the mechanism of FIG. 5, as illustrated in FIG. 8B.

Figure 8C:
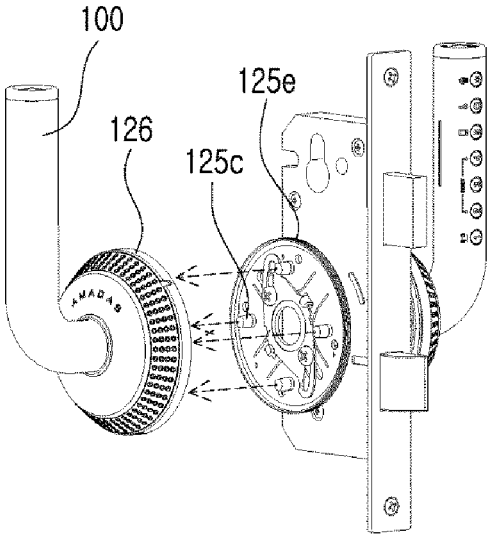

When the fastening bolts 124 and the fastening nuts 224 are fastened as illustrated FIG. 8C, the center of rotation of the outer device lever 210 and the center of rotation of the inner device interface bracket 125 are aligned to coincide with each other by the interval alignments 123, 223. Without the mechanism of the interval alignments 123, 223 described above, the center of rotation of the inner device 100 and that of the outer device 200 would not coincide with each other, and this may cause problem such as malfunction, failure and durability reduction.

Figure 6C:
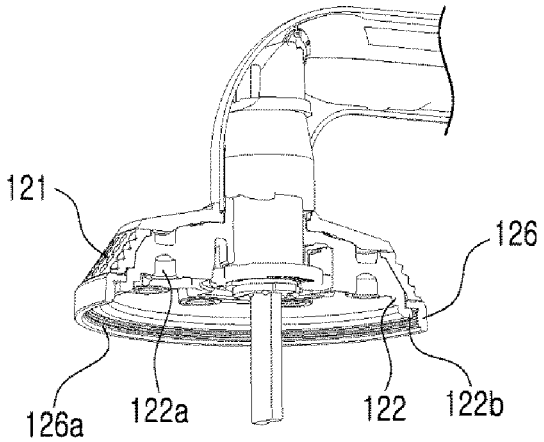
Figure 8D:
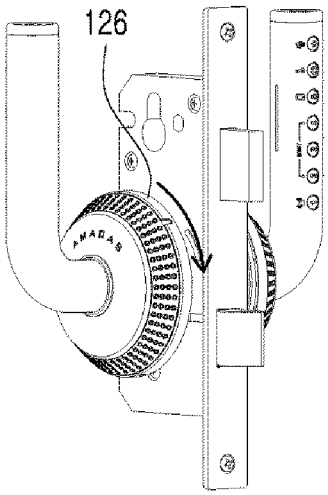

Referring to FIG. 8C, the stud 125*c* of the interface bracket 125 rotating at intervals of 45 degrees coincides with the stud groove 122*a* arranged as illustrated in FIG. 6 and the stud 125*c* is fitted in the stud groove 122*a* so that the alignment as illustrated in FIG. 8D is achieved.

When the bracket fixture 126 is rotated with respect to the interface bracket thread 125*e* to fix inner device 100 and the outer device 200 in this alignment state, the installation is completed.

Thereafter, the levers 110, 210 are rotated 90 degrees to the left or right depending on whether the door is left- or right-handed door, and the setting is completed.

The foregoing description is merely illustrative of the present disclosure, and various modifications may be made by those skilled in the art without departing from the spirit of the present disclosure.

Accordingly, the embodiments disclosed herein are not intended to limit the present disclosure. The scope of the present disclosure should be construed by following claims, and every technical art within a same scope of the following claims should be construed to be included in a scope of a right of the present disclosure.

DESCRIPTION OF THE REFERENCE NUMERALS

1: Door 10, 20: Locking device
11, 21: Fastening hole 12: Rotation cam hole
100: Inner device 110: Inner device lever
111, 211: Rotation key 200: Outer device
210: Outer lever
120: Inner device interface module
121: Bracket cover 122: Inner device bracket
123: Interval alignment 124: fastening bolt
125: Inner device interface bracket
220: Outer interface module
221: Bracket cover 222: Outer bracket
223: Interval alignment 224: fastening nut
225: Outer interface bracket

What is claimed is:

1. An interface module device of a door lock, comprising:
a bracket;
an interface bracket fastened with the bracket and defining longitudinal nut guides; and
an interval alignment disposed between the bracket and the interface bracket to adjust an interval between fastening nuts inserted into fastening holes of a locking device of the door lock, the interval alignment defining arched alignment holes;
wherein the fastening nuts are inserted into the nut guides and moved along the nut guides, and
wherein the interval alignment is configured to be fitted with engaging protrusions formed on the interface bracket and rotated, with head protrusions of the fastening nuts being fitted in alignment guides, so that when one of the fastening nuts is manually moved along one of the nut guides, the interval alignment is rotated and another one of the fastening nuts is moved with the rotation of the interval alignment to the opposite direction along the nut guides, so that the fastening nuts are capable of maintaining symmetry about a center of rotation of the alignment guides.

2. An interface module device of a door lock, comprising:
an inner device bracket;
an inner device interface bracket fastened with the inner device bracket and defining longitudinal bolt guides; and
an interval alignment disposed between the inner device bracket and the inner device interface bracket to adjust an interval between fastening bolts inserted into fastening holes of a locking device of the door lock, the interval alignment defining arched alignment holes;
wherein the fastening bolts are inserted into the bolt guides and moved along the bolt guides, and
wherein the interval alignment is configured to be fitted with engaging protrusions formed on the inner device interface bracket and rotated, with head protrusions of the fastening bolts being fitted in alignment guides, so that when one of the fastening bolts is manually moved along one of the bolt guides, the interval alignment is rotated and another one of the fastening bolts is moved with the rotation of the interval alignment to the opposite direction along the bolt guides, so that the fastening bolts are capable of maintaining symmetry about a center of rotation of the alignment guides.

3. The interface module device of a door lock according to claim 2, wherein the fastening bolts are fastened with fastening nuts previously inserted into the fastening holes of the locking device of the door lock, so that the interval alignment is fixed to the inner device interface bracket.

* * * * *